US006948215B2

(12) United States Patent
Malek et al.

(10) Patent No.: US 6,948,215 B2
(45) Date of Patent: Sep. 27, 2005

(54) WINDOW BALANCE

(76) Inventors: Neeman Malek, 1561 Alexandre Le Grand, Boisbriand (CA), J7G3C6; Rex Cross, 1899 Spindrift Dr., La Jolla, CA (US) 92037

( * ) Notice: Subject to any disclaimer, the term of this patent is extended or adjusted under 35 U.S.C. 154(b) by 0 days.

(21) Appl. No.: 10/029,042

(22) Filed: Dec. 19, 2001

(65) Prior Publication Data

US 2002/0124349 A1 Sep. 12, 2002

Related U.S. Application Data

(60) Provisional application No. 60/274,594, filed on Mar. 10, 2001.

(51) Int. Cl.[7] ..... E04C 2/34
(52) U.S. Cl. ..... 16/197; 49/445
(58) Field of Search ..... 16/197; 49/362, 49/445, 447

(56) References Cited

U.S. PATENT DOCUMENTS

| | | | | | |
|---|---|---|---|---|---|
| 889,064 | A | * | 5/1908 | Taylor | 49/445 |
| 1,414,698 | A | | 5/1922 | Karesiewiez | |
| 2,041,646 | A | * | 5/1936 | Larson | 16/197 |
| 2,053,479 | A | | 9/1936 | Huttger | |
| 2,365,156 | A | | 12/1944 | Viehweger | |
| 2,415,614 | A | * | 2/1947 | Tappan | 16/197 |
| 2,598,560 | A | | 5/1952 | Kenyon | |
| 2,776,447 | A | * | 1/1957 | Addicks | 16/197 |
| 2,792,588 | A | * | 5/1957 | Gency | 16/197 |
| 2,825,088 | A | * | 3/1958 | Decker | 16/197 |
| 2,825,089 | A | | 3/1958 | Larson et al. | |
| 2,826,781 | A | | 3/1958 | Gency | |
| 2,851,721 | A | * | 9/1958 | Decker | 16/197 |
| 2,890,480 | A | | 6/1959 | Gregg et al. | |
| 3,330,071 | A | * | 7/1967 | Kubisiak | 49/362 |
| 5,152,032 | A | | 10/1992 | Davis et al. | |
| 5,383,303 | A | * | 1/1995 | Nakanishi et al. | 49/181 |
| 6,115,884 | A | | 9/2000 | De Jong et al. | |

FOREIGN PATENT DOCUMENTS

| | | |
|---|---|---|
| GB | 2262123 A | 6/1993 |
| JP | 2001055861 A | 2/2001 |

* cited by examiner

*Primary Examiner*—Robert J. Sandy
*Assistant Examiner*—Andre' L. Jackson
(74) *Attorney, Agent, or Firm*—Robert A. Seemann

(57) ABSTRACT

A threaded follower mounted on a spiral rod is attached to the first end of a torsion spring, the second end of the torsion spring being connected to a window sash, one end of the spiral rod being attached to a window frame by a gear box that prevents rotation of the spiral rod unless the gear box receives externally provided rotational force by which it then rotates the spiral rod.

6 Claims, 5 Drawing Sheets

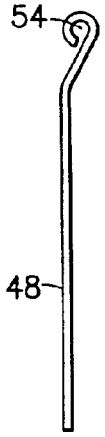
FIG.2
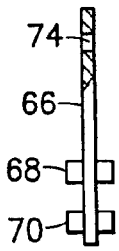
FIG.3
FIG.1
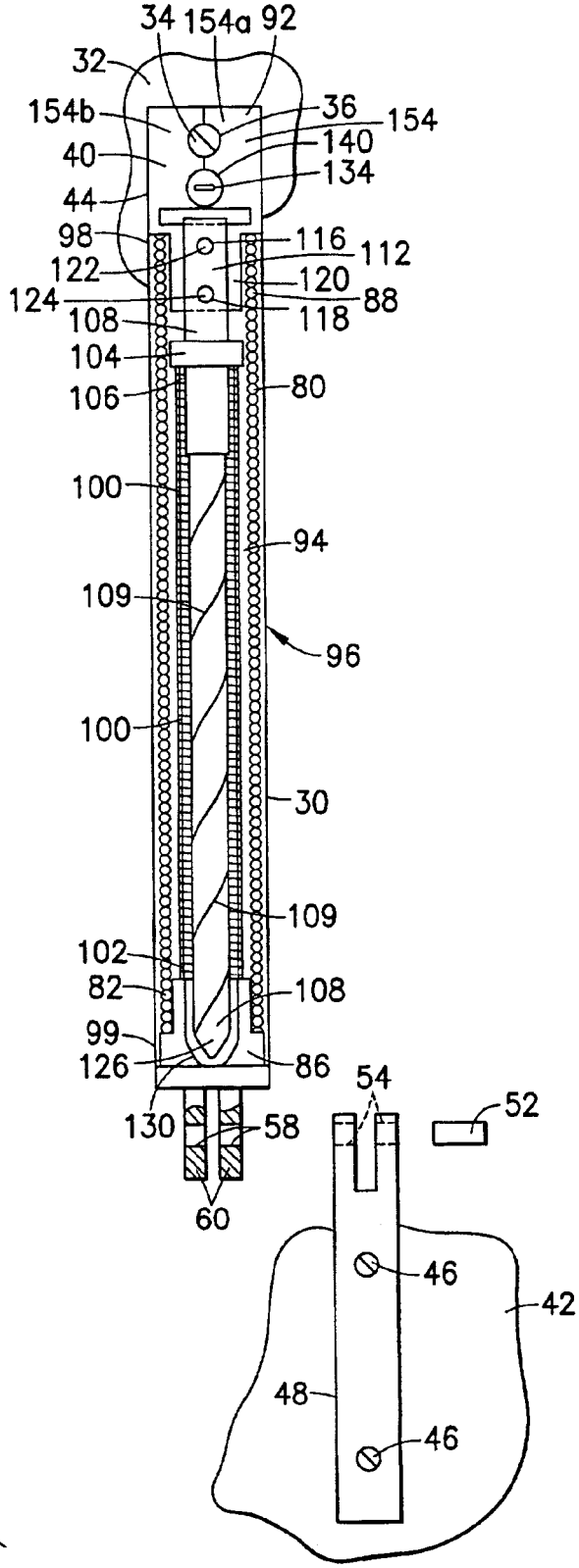

WINDOW BALANCE

This application claims the benefit of U.S. Provisional Application Ser. No. 60/274,594 filed Mar. 10, 2001.

BACKGROUND OF THE INVENTION

1. Field of the Invention

The invention relates to window balances, more specifically to preloading of a window balance that comprises a torsion spring and a tension spring.

2. Description of the Prior Art

U.S. Pat. No. 5,152,032 patented Oct. 6, 1992 by Davis et al. describes a tension plus torsion balance. In this tension plus torsion balance the torsion spring is turned at one end of the spring by a follower. The follower is rotated by a spiral rod that is threadably engaged with the follower so that moving the spiral rod longitudinally through the follower rotates the follower. The spiral rod is moved longitudinally by a window sash as the sash is lifted and lowered, by a first eyelet at one end of the rod that is attached to the window sash.

In order to provide a predetermined baseline lifting force to be transmitted back to the sash, the torsion spring is preloaded by gripping a second eyelet adjacent to the first eyelet when the first eyelet is not attached to the sash, and twisting the rod until the desired force is obtained, then while holding the rod at that rotational position, attaching the rod to the sash by the first eyelet. U.S. Pat. No. 5,152,032 is hereby incorporated by reference.

In M. H. Gregg et al. , U.S. Pat. No. 2,890,480 patented Jun. 16, 1959 the sash is lifted and the preload adjustment is made by moving a first driver of a dog-tooth clutch that is in axial alignment with the spiral rod, past a lock pin and into the second driver of the dog tooth that is attached to the end of the spiral rod, and turning the first driver.

In Larson et al., U.S. Pat. No. 2,825,089 patented Mar. 4, 1958 a slotted head for a screw driver is mounted in axial alignment on the end of the spiral rod. The head is journaled in a laterally oriented slot, pulled to one end of the slot against a ratchet pawl by a convolute spring. Increase in minimum lifting force is made by turning the screw as the pawl enters successive notches around the head. Decrease in minimum lifting force is made by moving the head laterally in the slot against the urging of the convolute spring until the notched periphery of the screw head is drawn away from the paw, and reversing the direction of the screw.

SUMMARY OF THE INVENTION

It is one object of the invention to provide a window balance that can be preloaded while the balance is attached to a window sash and window frame.

It is another object of the invention that the window balance is preloaded by turning a gear.

Other objects and advantages of the invention will become apparent to persons skilled in the art from the ensuing description.

A window balance includes a torsion spring having a first end and a second end, a spiral rod having a first end and a second end, a threaded follower mounted on the spiral rod for being rotated by the spiral rod when the follower is moved along the spiral rod between the first end and the second end of the spiral rod. The threaded follower is attached to the first end of the torsion spring for rotating the first end of the torsion spring by rotation of the follower.

The window balance also includes first means for attaching the second end of the torsion spring to a window sash for moving the follower along the spiral rod by moving the sash, second means for attaching the first end of the spiral rod to a window frame against rotation of the spiral rod. The second means for attaching includes means for rotating the spiral rod for changing base force in the torsion spring.

The window balance also includes a tension spring having a first end connected to the first means for attaching, and having a second end connected to the second means for attaching, and means for longitudinal engagement for prevention of differential rotational movement, connected to the first means for attaching and to the second means for attaching, for prevention of differential rotational movement between the first end of the tension spring and the second end of the tension spring when the first means for attachment is moved between a first distance and a second distance from the second means for attachment.

A window balance includes a torsion spring having a first end and a second end, a spiral rod having a first end and a second end, a threaded follower mounted on the spiral rod for being rotated by the spiral rod when the follower is moved along the spiral rod between the first end and the second end of the spiral rod, the threaded follower being attached to the first end of the torsion spring for rotating the first end of the torsion spring by rotation of the follower, first means for attaching the second end of the torsion spring to a window sash for moving the follower along the spiral rod by moving the sash, a gear bearing comprising means for attaching the gear bearing to a window frame against rotation of the gear bearing, a first gear, mounted in the gear bearing, connected to the spiral rod for rotating the spiral rod, second means for receiving external rotational force, mounted on the first gear, keyed to the first gear for rotating the first gear, means for urging the second means from a first position on the first gear to a second position on the first gear, and means mounted on the bearing configured for contacting the second means for preventing rotation of the second means when the second means is in the second position.

A window balance includes a window frame, a window sash movably mounted on the window frame, a torsion spring having a first end and a second end, a spiral rod having a first end and a second end, a threaded follower mounted on the spiral rod for being rotated by the spiral rod when the follower is moved along the spiral rod between the first end of the spiral rod and the second end of the spiral rod, the threaded follower being attached to the first end of the torsion spring for rotating the first end of the torsion spring by rotation of the follower, the second end of the torsion spring being mounted on the window sash for moving the follower along the spiral rod by moving the sash, a bearing housing attached to the window frame, a first gear mounted in the housing, axially connected to the spiral rod for rotating the spiral rod, a second gear rotationally engaged with the first gear for rotating the first gear, a keyed hole in the second gear, an insert in the keyed hole, keyed to the hole so that insert rotates the second gear when the insert is rotated, means for urging the insert from a first position on the second gear to a second position on the second gear, and means on the housing contacting the insert for preventing rotation of the insert when the insert is in the second position.

BRIEF DESCRIPTION OF THE DRAWINGS

In order that the invention will be more fully comprehended, it will now be described, by way of example, with reference to the accompanying drawings, in which:

FIG. 1 is a schematic cross section view of a balance of the invention including a bracket for attaching the balance to a sash.

FIG. 2 is a side view of the bracket of FIG. 1

FIG. 3 is a side view of another bracket for attaching the balance to a window sash by way of a balance shoe.

DESCRIPTION OF THE PREFERRED EMBODIMENTS

Figure 4:
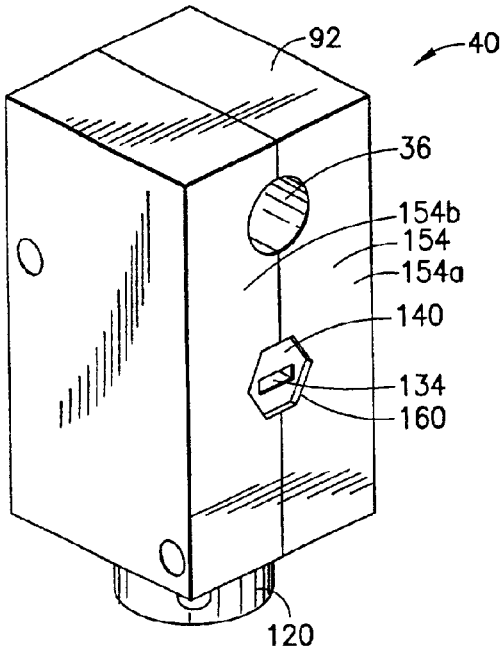
FIG. 4 is a perspective front view of a gearbox of the invention taken from above.
Figure 5:
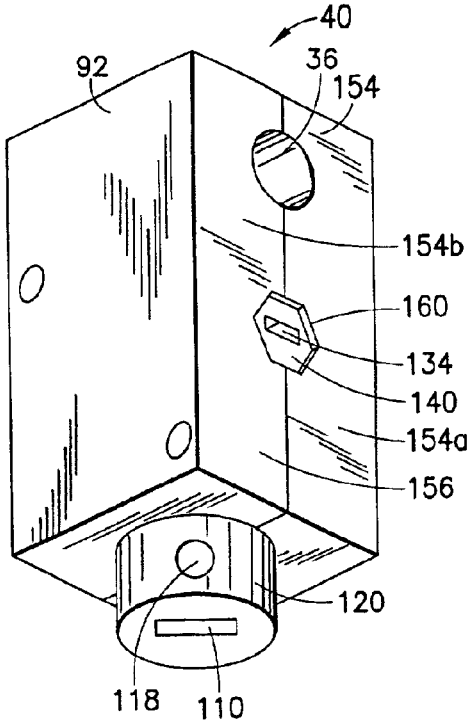
FIG. 5 is a perspective front view of the gearbox of FIG. 4 taken from below.
Figure 6:
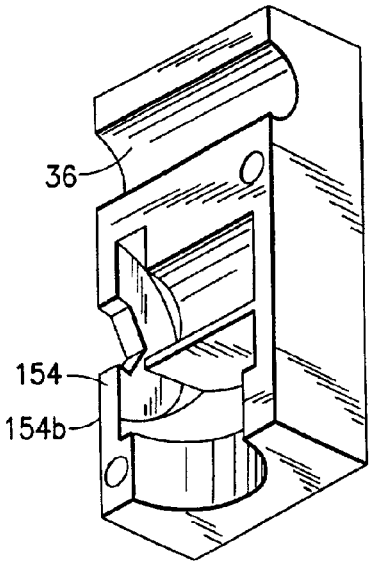
FIG. 6 is a perspective view of a first half of the split housing of the gearbox of FIG. 5 taken from below.
Figure 7:
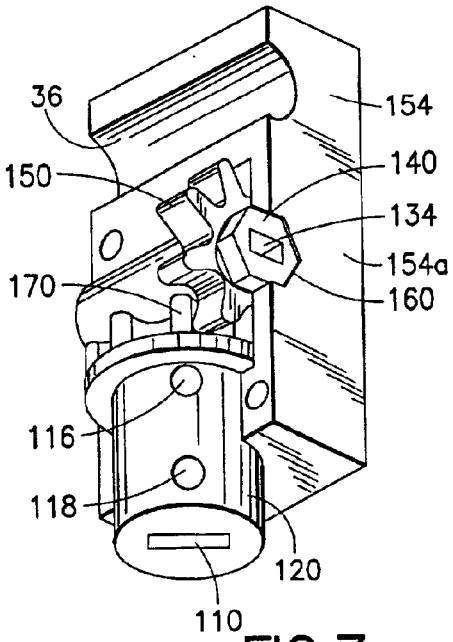
FIG. 7 is a perspective view of the second half of the split housing of the gearbox of FIG. 5 taken from below, containing the geartrain, the first and second sides of the split housing being mirror images of each other.
Figure 8:
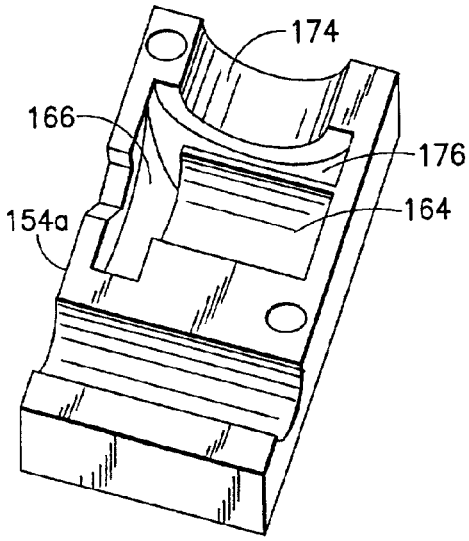
FIG. 8 is a perspective rotated view of one half of the gearbox of FIG. 5 taken from below.
Figure 9:
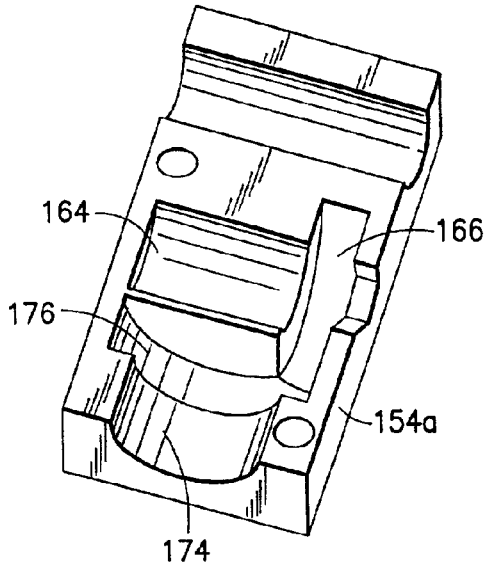
FIG. 9 is a perspective rotated view of one half of the gearbox of FIG. 5 taken from below.
Figure 10:
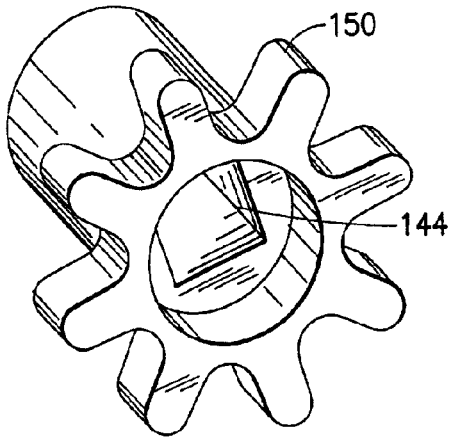
FIG. 10 is a perspective front view of a gear of the gearbox of FIG. 7.
Figure 11:
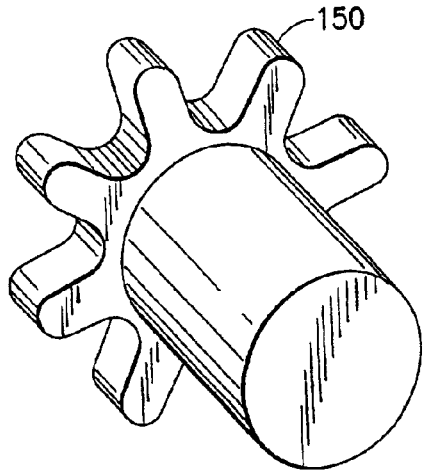
FIG. 11 is a perspective rotated view of the gear of FIG. 10.
Figure 12:
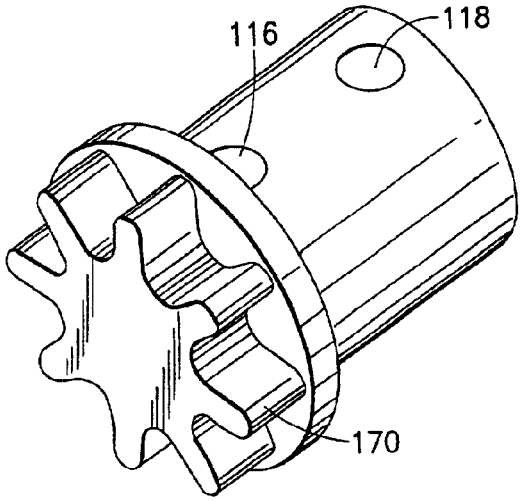
FIG. 12 is a perspective view of another gear of the gearbox of FIG. 7.
Figure 13:
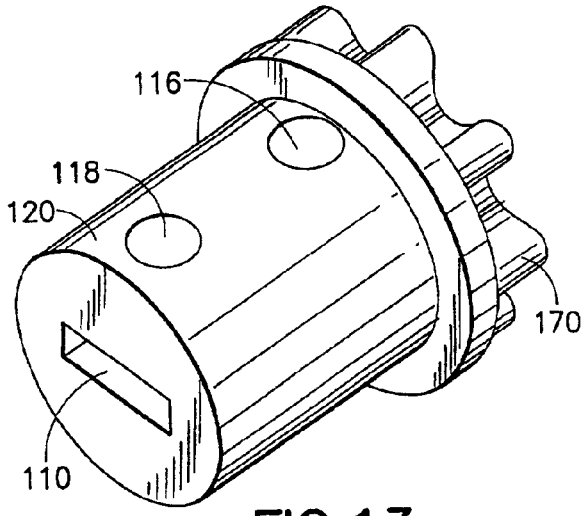
FIG. 13 is a perspective rotated view of the gear of FIG. 12.
Figure 14:
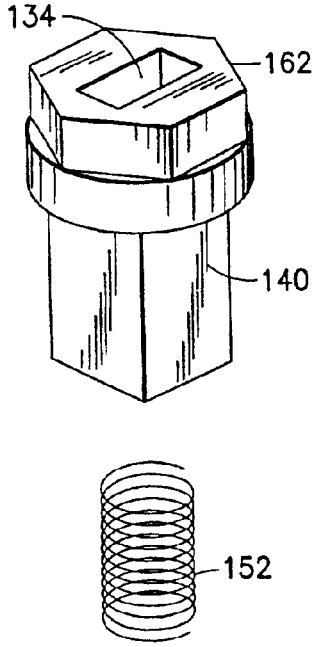
FIG. 14 is a perspective view of an insert of the gearbox of FIG. 7, taken from above, including a spring that is installed in the gear with the insert.
Figure 15:
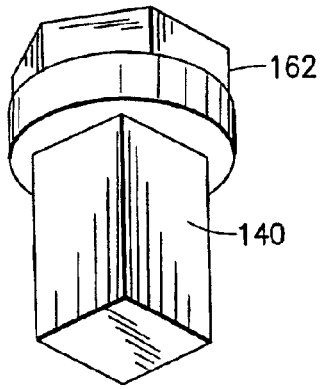
FIG. 15 is a perspective view of the insert of FIG. 14, taken from below, without the spring.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–5, tension plus torsion balance 30 is attached to the upper part of stile or window frame 32 by screw 34 which passes through hole 36 in housing 92 of gearbox 40 at top 44 of the balance.

Balance 30 is attached to sash 42 by screws 46 through bracket 48 which is attached by pin 52 through holes 54 in the bracket and holes 58 in lugs 60 at the bottom of balance 30.

Balance 30 may be attached to a sash by way of one of the many shoes commercially available for attaching a balance to a sash. For this, metal strip 66 instead of bracket 48 is attached to lugs 60 by pin 52 through hole 74 in the strip and holes 58 in lugs 60. Studs 68, 70 are provided on the strip for engaging a shoe.

Extension or tension spring 80 is fixedly attached at lower end 82 of the spring to block 86 which is fixedly attached to lugs 60. The spring is fixedly attached at upper end 88 of the spring to the housing 92 of gearbox 40.

Tube 96 is fixedly attached at end 98 of the tube to housing 92 of gearbox 40. The other end, 99, of the tube is unattached. Tube 96 covers spring 80 insofar as spring 80 is not extended. When spring 80 is extended or stretched by sash drawing block 86 downward, a portion of the lower end of the stretched spring past the free lower end of the tube is not covered by the tube.

Torsion spring 100 is fixedly attached at lower end 102 of the spring to block 86, and is fixedly attached at lop end 106 of the spring to internally threaded follower 104 which is rotated by the threads 109 of threaded spiral rod 108.

Tube 94 separates spring 80 from spring 100 to prevent one rubbing against the other.

Spiral rod 108 is shown in FIG. 1.

Upper end 112 of spiral rod 108 is fixedly attached by pins 122, 124 in holes 116, 118 of slotted shaft 120 of gearbox 40. Spiral rod 108 extends from slot 110 in shaft 120. Lower end 126 of spiral rod 108 is not restricted from rotating. In FIG. 1, lower end 126 is shown removably extending into recess 130 of block 86, but when the block is drawn down, away from screw 34, end 126 is left depending downward above and outside of recess 130.

As block 86 is moved downward and upward by a window sash, the block moves torsion spring 100 upwards and downward. Since the upper end of spring 100 is attached to follower 104, spring 100 moves follower 104 upward and downward along threaded spiral rod 108.

The follower, rotated by the threads 109 of rod 108 as the follower moves up and down the rod, rotates top end 106 of torsion spring 100. Rotation of torsion spring 100 as the sash is lowered, stores twisting force in the torsion spring that is translated into lifting force upon the torsion spring by the follower, and upon lugs 60 by the torsion spring, as the twisting force urges the follower to wind its way up the thread of the spiral rod.

In order to provide a minimum lifting force, herein called a "base force", other than the lifting force stored in spring 100 by lowering a sash to wind the spring, a screw driver is inserted into tool hole 134 in keyed insert 140 and is turned. Insert 140 is set into keyed hole 144 in gear 150, urged outward of the keyed hole by spring 152, but prevented from exiting the keyed hole by wall 154 comprising wall portions 154*a*, 154*b*, of the halves of gearbox 40 housing 92.

Hexagonal opening 160 of wall 154, comprising wall portions 154*a*, 154*b*, engages hexagonal head 162 of insert 140 preventing rotation of gear 150 unless the head and insert is pushed behind wall 154 by pushing inward on the screw driver.

Gear 150 rotationally engages gear 170 which turns shaft 120.

Preferably when gear 150 is turned to add base force, block 86 is restrained from turning relative to housing 92 of gear box 40 by means other than that of the resistance to twist of tension spring 80. Attaching the balance to a window frame and window sash provides a restraint that prevents turning of block 86.

Thus, base force can be added, increased, or reduced while the balance is attached to the window frame and sash. This is an advantage over balances that require disconnection from the sash or window frame in order to add or change the base force in a torsion spring and follower assembly.

Gear 150 turns in bearing liner halves 164 and gear tooth clearance slot halves 166.

Gear 170 turns in bearing liner halves 174 and gear tooth clearance slot halves 176.

Figure 16:
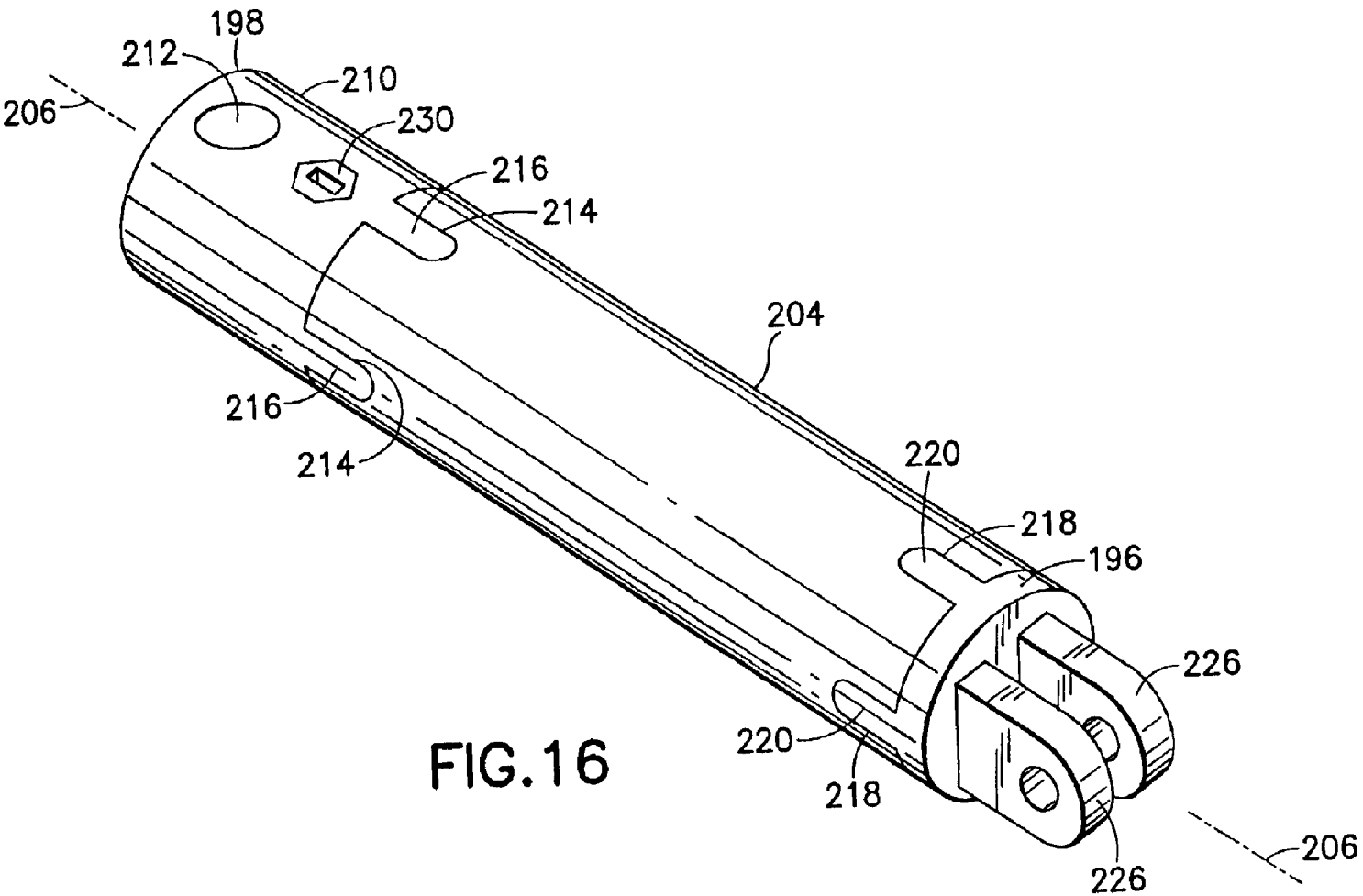
FIG. 16 is a perspective view of another balance of the invention.

In FIG. 16, block 196 of tension plus torsion balance 198 is prevented by tube 204 from rotating on axis 206 relative to gearbox housing 210 by longitudinal engagements of finger, groove 216, 214 and groove, finger 218, 220.

Longitudinal grooves 214 receive longitudinal fingers 216. Longitudinal grooves 218 receive longitudinal fingers 220. Thus, when gearbox housing 210 is fixed to a window frame by a screw through hole 212, block 196 cannot rotate on axis 206 relative to the frame or to gearbox housing 210, even when lugs 226 are not connected to a sash against rotation and when block 196 is moved axially away from gearbox housing 210, so long as at least one finger and groove 214, 216 and at least one finger and groove 218, 220 are engaged at each end of the balance.

The longitudinal engagements are not limited to finger and groove, but can be finger and slot, pin and hole or other longitudinal arrangement that stays in longitudinal alignment when block 196 is moved away from gear housing 210. Base force in balance 198 can be adjusted by winding the spiral rod (not shown) by pushing in and turning insert 230 even when the gearbox housing is attached to a window frame while lugs 226 are left free, not attached to a sash.

The longitudinal engagement can be between one end only of the tube and either one of the gearbox and the block, the other end of the tube being fixedly attached to or extending from the other of the gearbox and the block.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A window balance comprising:

a window frame, a window sash movably mounted in said window frame, a torsion spring having a first end and a second end, a spiral rod within said torsion spring having a third end near the first end, a fourth end near the second end, and a first axis through the third end and the fourth end, a threaded follower mounted on said spiral rod for being rotated by said spiral rod when said follower is moved along said spiral rod between the third end and the fourth end of said spiral rod, said threaded follower being attached to the first end of said torsion spring for rotating the first end of said torsion spring by rotation of said follower, first means for attaching the second end of said torsion spring to a window sash for axial movement of said torsion spring by the sash for moving said follower along said spiral rod by moving the sash, attached to said window sash, a gear assembly comprising a first gear and a second gear, fixedly mounted on said window frame, attached to the third end of said spiral rod preventing axial movement of said spiral rod with respect to the window frame and for rotating said spiral rod by said first gear when said first gear is driven by said second gear for changing base force in said torsion spring, an axially extending first element mounted on one of said first means and said gear assembly, a second element mounted on the other of said first means and said gear assembly axially receiving said first element spaced radially from the axis of the spiral rod when the follower is adjacent to the third end of said spiral rod so that said first element extending a first length into said second element prevents axial rotation of said first means with respect to said gear assembly, the first length being such that said first element is withdrawn from said second element permitting axial rotation of said first means with respect to said gear assembly when said first means is moved axially away from said gear assembly.

2. A window balance comprising:

a window frame, a window sash movably mounted in said window frame, a torsion spring having a first end and a second end, a spiral rod within said torsion spring having a third end near the first end, a fourth end near the second end, and a first axis through the third end and the fourth end, a threaded follower mounted on said spiral rod for being rotated by said spiral rod when said follower is moved along said spiral rod between the third end and the fourth end of said spiral rod, said threaded follower being attached to the first end of said torsion spring for rotating the first end of said torsion spring by rotation of said follower, first means for attaching the second end of said torsion spring to a window sash for axial movement of said torsion spring by the sash for moving said follower along said spiral rod by moving the sash, attached to said window sash, the fourth end of said spiral rod being disconnected from said first means for attaching so that said spiral rod is not moved by said first means for attaching when the sash moves said torsion spring axially, a gear assembly comprising a first gear and a second gear, fixedly mounted on said window frame, attached to the third end of said spiral rod preventing axial movement of said spiral rod with respect to the window frame and for rotating said spiral rod by said first gear when said first gear is driven by said second gear for changing base force in said torsion spring.

3. The window balance of claim 2 further comprising:

a tension spring attached to said gear assembly and to said first means.

4. The window balance of claim 2 further comprising:

a keyed hole in said second gear, an insert in said keyed hole, keyed to said hole so the insert rotates said second gear when said insert is rotated, means for urging said insert from a first position on said second gear to a second position on said second gear.

5. A window balance comprising:

a window frame, a window sash movably mounted in said window frame, a torsion spring having a first end and a second end, a spiral rod within said torsion spring having a third end near the first end, a fourth end near the second end, and a first axis through the third end and the fourth end, a threaded follower mounted on said spiral rod for being rotated by said spiral rod when said follower is moved along said spiral rod between the third end and the fourth end of said spiral rod, said threaded follower being attached to the first end of said torsion spring for rotating the first end of said torsion spring by rotation of said follower, first means for attaching the second end of said torsion spring to a window sash for axial movement of said torsion spring by the sash for moving said follower along said spiral rod by moving the sash, attached to said window sash, a gear assembly comprising a first gear and a second gear, fixedly mounted on said window frame, attached to the third end of said spiral rod preventing axial movement of said spiral rod with respect to the window frame when said means for attaching is moved axially by the shaft and for rotating said spiral rod by said first gear when said first gear is driven by said second gear for changing base force in said torsion spring.

6. A window balance comprising:

a window frame, a window sash movable mounted in said window frame, a torsion spring having a first end and a second end, a spiral rod within said torsion spring having a third end near the first end, an unattached fourth end near the second end, and a first axis through the third end and the fourth end, a block fixedly attached to the second end of the torsion spring, the block having formed therein a recess for removably receiving the unattached fourth end of the spiral rod, a threaded follower mounted on said spiral rod for being rotated by said spiral rod when said follower is moved along said spiral rod between the third end and the fourth end of said spiral rod, said threaded follower being attached to the first end of said torsion spring for rotating the first end of said torsion spring by rotation of said follower, first means for attaching the block situated at the second end of said torsion spring to a window sash for axial movement of said torsion spring by the sash for moving said follower along said spiral rod by moving the sash, attached to said window sash, and a gear assembly fixedly mounted on said window frame, attached to the third end of said spiral rod preventing axial movement of said spiral rod with respect to the window frame and for rotating said spiral rod for changing base force in said torsion spring.

* * * * *